US006207112B1

(12) United States Patent
Spallek et al.

(10) Patent No.: US 6,207,112 B1
(45) Date of Patent: Mar. 27, 2001

(54) PISTON BURETTE FOR A BURETTE APPARATUS

(75) Inventors: Michael Spallek, Ingelheim; Jochen Heinz, Vendersheim, both of (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 09/148,593

(22) Filed: Sep. 4, 1998

(30) Foreign Application Priority Data

Sep. 6, 1997 (DE) ..... 197 39 140

(51) Int. Cl.[7] ..... B01L 3/02

(52) U.S. Cl. ..... 422/100; 422/103; 422/104; 436/54; 436/180; 73/864.13; 73/864.16

(58) Field of Search ..... 422/100, 103, 422/104, 919, 920, 921, 922, 923, 925, 926, 931; 436/180, 54; 222/63, 74, 75; 73/864.16, 864.13, 864.87

(56) References Cited

U.S. PATENT DOCUMENTS

| | | | | |
|---|---|---|---|---|
| 3,905,768 | | 9/1975 | Hach . | |
| 3,931,915 | | 1/1976 | Downings et al. . | |
| 4,047,850 | | 9/1977 | Berthelot . | |
| 4,086,062 | * | 4/1978 | Hach | 23/259 |
| 4,429,583 | * | 2/1984 | Watanabe et al. | 73/864.12 |
| 4,738,826 | * | 4/1988 | Harris | 422/100 |
| 4,874,808 | * | 10/1989 | Minami et al. | 524/291 |
| 4,973,450 | * | 11/1990 | Schulter | 422/101 |
| 5,440,940 | * | 8/1995 | Wilkins | 73/864.16 |
| 5,597,530 | * | 1/1997 | Smith et al. | 422/28 |
| 5,747,350 | * | 5/1998 | Sattler | 436/180 |
| 5,763,278 | * | 6/1998 | Sickinger et al. | 436/180 |
| 5,900,285 | * | 5/1999 | Walther et al. | 427/491 |
| 5,998,214 | * | 12/1999 | Guirguis | 436/165 |
| 6,053,895 | * | 4/2000 | Kolberg et al. | 604/218 |

FOREIGN PATENT DOCUMENTS

| | | |
|---|---|---|
| 44 38 359 A1 | 5/1996 | (DE) . |
| 197 39 140 C1 | 4/1999 | (DE) . |
| 0 086 912 | 8/1983 | (EP) . |
| 0 556 034 A1 | 8/1993 | (EP) . |
| 0 524 802 B1 | 11/1996 | (EP) . |

* cited by examiner

*Primary Examiner*—Maureen M. Wallenhorst
*Assistant Examiner*—Kathryn Bex
(74) *Attorney, Agent, or Firm*—Michael J. Striker

(57) ABSTRACT

The piston burette for storing and dispensing a reagent used in analytical or metering work includes a calibrated burette cylinder (11) and a piston (13) slidably mounted in it. The piston burette includes a burette cylinder (11) provided with an outlet opening (12) at one end thereof and made of a plastic material by high precision injection molding with close tolerances, wherein from 10 to 100% by weight of the plastic material is a cycloolefin copolymer (COC); an attachment device (15) for releasable attachment of the burette cylinder to or in a burette apparatus (10); a predetermined amount of the reagent pre-filled in the burette cylinder; a device for retaining the reagent in the burette cylinder (11) including a removable closing cap (18,23) closing the outlet opening (12) at the one end of the burette cylinder; a liquid conducting device for feeding of the reagent from the burette cylinder including a metering tube (19) provided with a connector (21) for connection of the metering tube with the outlet opening (12) of the burette cylinder, when the removable cap is removed, in order to conduct the liquid from the burette cylinder; and a piston (13) slidably mounted in the burette cylinder (11) to close another end of the burette cylinder remote from the one end closed by the closing cap (18).

6 Claims, 3 Drawing Sheets

FIG. 2
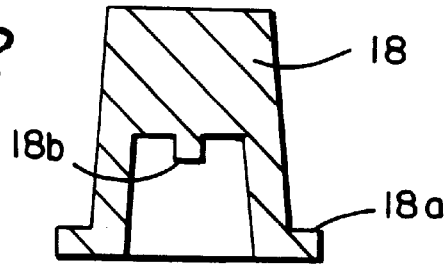
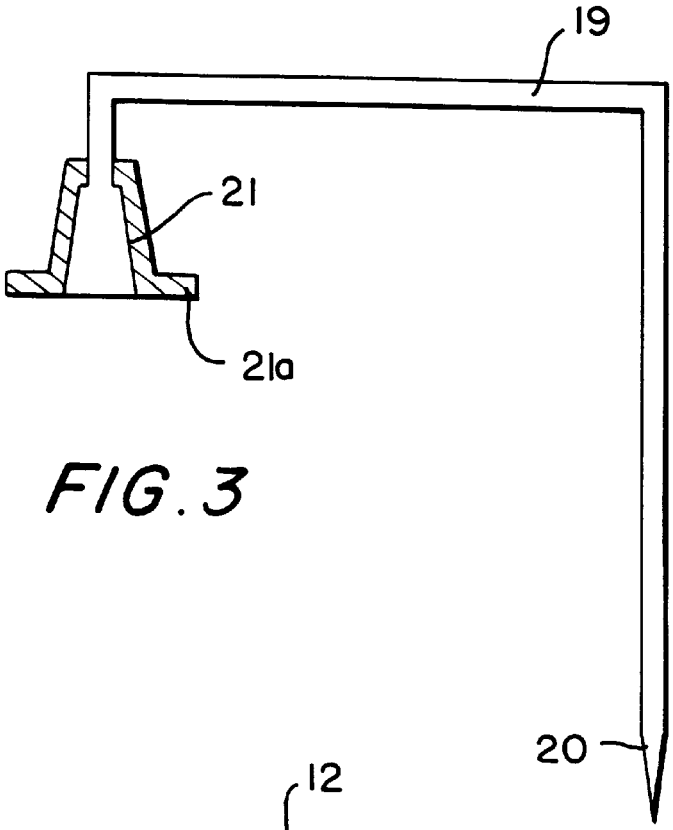
FIG. 3
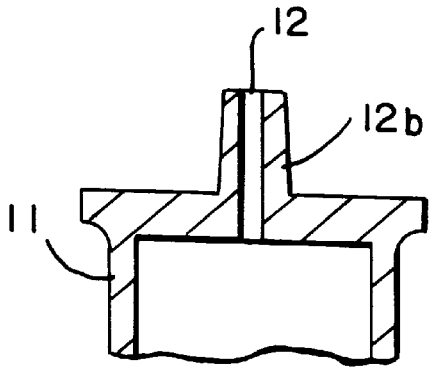
FIG. 4

PISTON BURETTE FOR A BURETTE APPARATUS

BACKGROUND OF THE INVENTION

1. Field of the Invention

The present invention relates to a piston burette for a burette apparatus with a burette cylinder that has an outlet opening at one end and in which a piston is slidably mounted.

2. Prior Art

A burette is a transparent tube or cylinder that can be filled with a reagent and that is provided with an etched scale and an outlet opening for controlled delivery of the reagent. The burette is used in quantitative analysis for volumetric measurement of materials. The piston burette is a special form of a burette that is used primarily in analytical chemistry for determination of unknown amounts of materials in samples by means of a titration or in microbiology or genetic engineering. They require a highly precise working device, so that the geometric structure of the piston burette has high precision specifications, especially for the inner diameter of the burette cylinder.

While in the classical burette the reagent is dispensed by means of gravity from a vertically standing glass tube filled with reagent and provided with a tap or stopcock, in the piston burette the burette cylinder is formed as a glass tube in which a piston is slidably mounted to supply or dispense the reagent. The metered volume is measured and indicated by displacement of the piston.

Piston burettes of this type are part of the current state of the art.

FIG. 6 shows the principle of operation of the prior art piston burette. A piston 3 that can move up and down manually or by means of an unshown motor is arranged in a calibrated glass tube acting as the burette cylinder. Two valves 1,2 are required for operation of the known piston burette. The suction valve 1 opens during withdrawal of the reagent from the cylinder 4 and the outlet valve 2 opens when the reagent is forced out from the cylinder. In the idle state of the piston—and of course in every arbitrary position between the upper and lower end points acting as limits of its travel—both valves are closed. The position of the valves is shown in FIG. 6.

In analytical chemistry applications the suction valve 1 is connected by a suction tube 6 with a supply container 7 in which a reagent of known composition and concentration is located. The outlet valve 2 is connected by means of a delivery tube 5 with an apparatus, usually a titration tip, which is located above an unshown receiving flask containing an unknown solution (analysis flask).

During the analysis the reagent is drawn from the supply vessel 7 by a downward motion of the piston 3 and, after switching the valve system, delivered into the analysis flask in exact volume increments via the titration tip by means of piston motion in the other direction. The analysis is ended, when the reaction in the analysis flask is completed which is established with the help of a sensor or a color change occurring in the analysis flask. The amount of reagent solution delivered is read from the scale of the piston burette and determined from the number of the volume increments and the analysis results calculated.

The piston burette is integrated in a burette apparatus including other components. It requires a comparatively expensive valve system connected via two openings with the burette cylinder, since the accuracy of the volume determination depends on the precision with which the valve system operates, especially regarding the possible leakage and total volume of the valve system. Furthermore a highly constant inner diameter over the entire length of the burette cylinder is decisive for the accuracy and precision of the volume determination. For that reason a special calibrated glass tube, the so-called precision dilution device, that is shrunk on an inner mandrel in a hot molding process, is usually used. The known burette cylinder made from glass is thus very expensive and has the disadvantage that it is susceptible to breakage. Multiple usage of the known burette cylinder is somewhat difficult because of the necessity of troublesome cleaning work when the reagent is changed. The valve system, the piston burette the vacuum or suction tubing from the reaction vessel and the piston must be cleaned, dried and reassembled which is a disadvantage.

Furthermore a separate supply vessel is required for the reagents that is connected by means of connecting tubes with the valve system.

A metering device with a piston/cylinder system that is not a piston burette, but which of course can be used in an analogous manner as a burette, is known from German Patent Application DE 43 10 808 A1. This known metering device, which can be formed as a pre-filled device in the same sense as a one-time-use product, is based on glass cylinders made in the usual manner that have diameters that fluctuate from cylinder to cylinder and accounts for these diameter fluctuations, because the interior diameter is measured for each individual burette cylinder and supplied preferably in the form of a machine readable bar code, i.e. marked on it in the case of the bar code and is used in electronic computations of the amount of material metered from the device.

This known device has decisive disadvantages.

The individual inner diameter must be measured for each individual metering cylinder and supplied or marked individually in an expensive process.

Furthermore with pre-filled metering cylinders a change of the metering cylinders by electronic diameter preparation' is difficult. The new diameters must be set in the electronic metering unit in operation and that requires trained operating personnel.

An additional disadvantage of this known metering cylinder is that diameter-adjusted piston plugs having different diameters must be used, which makes a search process' necessary in the manufacture of pre-filled metering cylinders and also suitable storage and logistics are required. If this is not done, i.e. if one does not operate with a plug of a predetermined diameter, mechanical problems result because the metering cylinder is too narrow which in the worst case can lead to a friction force between the piston and cylinder wall which cannot be overcome, the above-named reference not mentioning any type of lubricant in any embodiment.

SUMMARY OF THE INVENTION

The present invention relates to a piston burette for a burette apparatus that it substantially simpler in its structure and handling than the current prior art piston burette.

According to the invention, the piston burette arrangement for dispensing and storing a reagent comprises a burette cylinder provided with an outlet opening at one end thereof and made of a plastic material by injection molding with high precision and narrow tolerances, wherein from 10 to 100% by weight of the plastic material consists of a cycloolefin copolymer (COC);

means for releasable attachment of the burette cylinder in a burette apparatus for the piston burette;

a predetermined amount of the reagent pre-filled in the burette cylinder;

means for retaining the reagent in the burette cylinder comprising a removable closing cap closing the outlet opening at the one end of the burette cylinder;

means for conducting the reagent from the burette cylinder comprising a metering tube provided with a connector, when the removable closing cap is not closing the outlet opening, so that the liquid reagent can be conducted from the burette cylinder; and a piston slidably mounted in the burette cylinder to close another end of the burette cylinder opposite or remote from the one end that can be provided with the closing cap.

The piston burette according to the invention has a burette cylinder which is made with a precise inner diameter and which is the same for all burette cylinders made with predetermined specifications and dimensions. The burette cylinder made in this manner thus has a uniform constant diameter from cylinder to cylinder.

The features and steps previously required for a reliable manufacture of the metering cylinder described in German Patent Application DE 43 10 808 A1 can be eliminated in the present invention, since a constant diameter from cylinder to cylinder is so-to-say guaranteed by the simple manufacturing process itself—the injection molding—ab ovo, i.e. from the start. The cost situation is however just with the one-time-usage article, so that it is essentially the same for all embodiments of the invention.

The plastic burette cylinder according to the invention can be economically manufactured with high precision including a predetermined amount of the liquid reagent and, in that form, is suitable for one-time usage dispensing the liquid reagent contained in it, so that cleaning procedures are not necessary. For different reagents different pre-filled burette cylinders with different volumes are manufactured, stored and used as storage containers.

The plastic burette cylinder according to the invention can be integrated in a simple manner safe from breakage in the standard burette apparatus and can be made in a simple way with narrow tolerances, especially when it is made by injection molding. The injection molding provides the required narrow tolerances for the burette cylinder. The selection of transparent plastic for the burette allows optical control of the contents, control of the air bubbles, etc. The plastic material can be colored in order to provide some protection of the reagent contained in the burette cylinder from light.

The plastic used, which contains cycloolefin copolymers, is very inert to the usually contained reagents, and it furthermore has a very much reduced moisture permeability, so that the pre-filled burette cylinder has a comparatively long shelf life during which the concentration of the reagent does not change in an unreliable manner. Also mechanical deformation of the burette cylinder is prevented during metering by the hardness of the plastic material.

The requirement for switching and/or operating a valve system connected with a supply container for the reagent is eliminated using burette cylinders according to the invention that are pre-filled with reagent, e.g. a titration solution. Also the burette cylinder of the invention does not have an inlet opening but only an outlet opening for the pre-filled reagent. The pre-filled burette cylinder can advantageously operate simultaneously as a storage container for the reagent to be used. Since the piston burette can be simply, rapidly and reliably mounted on the piston burette apparatus, the invention guarantees also a rapid and reliable operation of the apparatus and changing of the reagents. In contrast to the metering device described in German Patent Application DE 43 10 808 A1 the pre-filled burette cylinders can be changed purely mechanically and manually without having to take other considerations into account, since the diameter of the individual pre-filled burette cylinders are already held constant during manufacture.

Another embodiment according to the invention in which the burette cylinder is made from a plastic material comprising polyethylene naphthylate (PEN), polyethylene terephthalate (PET) or a blend thereof is particularly preferably for oxidation sensitive reagents, such as thiosulfate solution, which can be oxidized by oxygen during storage.

According to another embodiment of the invention the plastic wall of the burette cylinder is provided with a barrier layer, preferably against oxygen, for very sensitive reagents, or with a bag made of aluminum foil for a longer shelf life or a special gas barrier foil.

The burette cylinder can also be made from several layers of different plastic material, i.e. it can have a multilayer plastic wall.

According to an additional embodiment of the invention the burette cylinder can be provided with a lubricant, such as silicone oil, to reduce the friction between the piston and cylinder. The lubricant can already be provided with or in the plastic material in an appropriate manner during the molding of the burette cylinder in the injection molding process. It also helps to attain the goal of avoiding mechanical deformation of the plastic burette cylinder which was described as a disadvantage of the known plastic metering cylinder described in German Patent Application DE 43 10 808 A1. This is in addition to the advantage that the invention has in this regard which was attained by using hardened COC plastic material.

The closing cap closing the individual outlet opening in the metering cylinder, especially the burette cylinder, is made especially of a hard elastomer, preferably rubbers, such as a halogen butyl rubber, silicone elastomer or thermoplastic elastomer.

The movable piston is preferably made from a stiff plastic material, such as a fluoropolymer, PTFE, ETFE, FEP or another plastic material, with a reduced friction coefficient and high chemical resistance to chemical reaction. Similarly elastomers with a fluoro-polymeric coating can be used; for simple applications usually rubber materials, such as bromo- or chlorobutyl rubbers are usable.

BRIEF DESCRIPTION OF THE DRAWING

The objects, features and advantages of the invention will now be illustrated in more detail with the aid of the following description of the preferred embodiments, with reference to the accompanying figures in which:

FIG. 2 is a longitudinal cross-sectional view through one embodiment of a closing cap for the tapered connector;

FIG. 3 is a diagrammatic longitudinal cross-sectional view through a metering tube with a titration tip and a connector for connection to the tapered connector;

FIG. 4 is a cutaway longitudinal cross-sectional view through a portion of the burette cylinder with a simplified tapered connector at its outlet opening;

DESCRIPTION OF THE PREFERRED EMBODIMENTS

Figure 1:
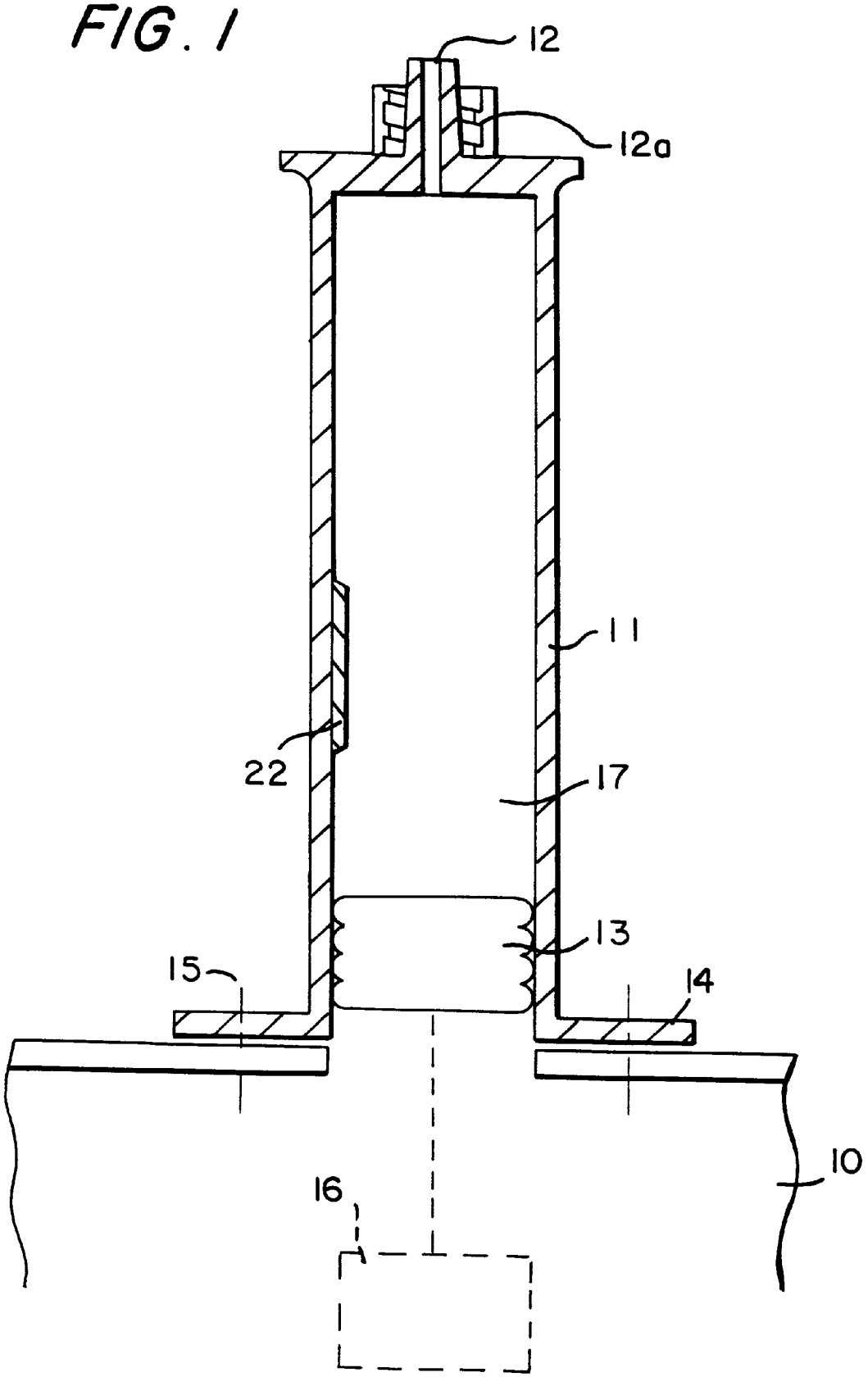
FIG. 1 is a longitudinal cross-sectional view through a piston burette according to the invention having a closable tapered connector at its outlet opening.
Figure 6:
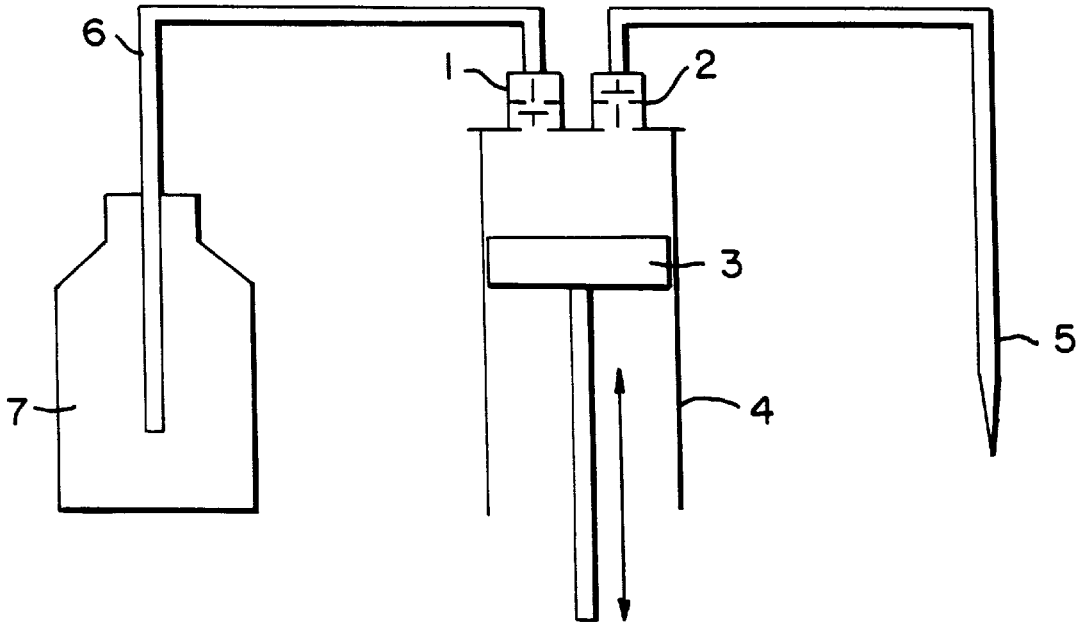
FIG. 6 PRIOR ART
FIG. 6 is a diagrammatic longitudinal cross-sectional view through a burette apparatus of the prior art.

FIG. 1 is a piston burette for a burette apparatus 10, comprising a burette cylinder 11, which has an outlet opening 12 with a closable tapered connector 12*a*. The tapered connector may be replaced by a bayonet coupling, a threaded connection, a compression joint or other types of connection. A piston 13 is slidably mounted in the burette cylinder 11, which simultaneously operates as a stopper during storage of the piston burette. The burette cylinder 11 is provided with a flange 14 at its end remote from the tapered connector and means 15 for attachment shown symbolically passing through the shoulder 14. The means 15 for attachment may be any of a variety of known means connected with the burette apparatus. Instead of the flange 14 an exterior thread for screwing the burette cylinder 11 into a base, stand or the like can be provided on the end of the burette cylinder remote from the tapered connector or that end can have a smooth outer surface which is clamped in a twist-lock or similar chuck.

A symbolically shown drive 16 for moving the piston 13 is arranged inside the burette apparatus.

Instead of the motorized motion the arrangement can be designed so that the piston is movable manually.

The burette cylinder 11 is filled with a reagent 17 and tightly closed on one end by the piston 13 and on the other end by closing cap 18 covering the outlet opening 12. This closing cap 18 is securely connected to the closable tapered connector 12*a* by screwing a flange-like lower edge 18*a* of the cap onto it, which can extend only partially around its periphery or circumference and which functions as an outer thread, so that an interior projecting portion 18*b* of the cap 18 seals the outlet opening 12.

This burette cylinder 11 is mounted after being filled, i.e. in the case of use it is connected with or in the burette apparatus and at the same time forms a storage container for the reagent to be used. After that the closure cap is removed and the metering tube 19 including its titration tip 20 according to FIG. 3 is crewed on the tapered connector 12*a* with its cap-like tapered connector 21 which is similarly provided with an outer thread 21*a* like the closing cap according to FIG. 2. After that the piston burette is operational.

The burette cylinder 11 is made of plastic material. A plastic material made predominantly of transparent cycloolefin copolymers (COC), e.g. TOPAS®, Type 8007, of Hoechst AG, APEL® of Fa, Mitsui Petrochemical or Zeonex® of Fa. Nippon Zeon, has special significance in regard to a long lifetime or long service life.

The wall thickness of the burette cylinder amounts to advantageously about 1 mm with tolerance of the inner diameter of less than 0.1 mm, which results in a very high dosage accuracy.

The closing cap 18 according to FIG. 2 is advantageously made of halogen butyl rubber, or another suitable elastomer or thermoplastic elastomer (TPE).

The piston 13 advantageously is made of PTFE, halogen butyl rubber or TPE.

A plastic material with reduced oxygen permeability, such as polyvinyl chloride (PVC), polyethylene naphthylate (PEN) or other polyester, can advantageously be used for oxidation sensitive liquid reagents, e.g. thiosulfate solutions, which can be oxidized by oxygen during storage.

A barrier layer 22 which is at least partially impermeable to oxygen may be applied to the interior surface of the burette cylinder 11 made of plastic material in the case of very sensitive reagents. A section of this barrier layer 22 is shown in FIG. 1. The application of this type of barrier layer is known in the art and is described in German Patent Application DE 44 38 359 A1.

The burette cylinder 11 including the flange 14 is preferably made by injection molding. A lubricant can already be provided in the plastic material during formation of the burette cylinder.

In FIG. 4 another embodiment of the piston burette having a different burette cylinder 11 with a different type of head is shown. A non-closable tapered connector 12*b* is provided according to FIG. 4 instead of the closable tapered connector 12*a* , which is closable with an elastomeric cap analogous to that of FIG. 2 as long as the burette cylinder operates as a storage container. However the connector for the metering tube 19 can be used as the connector (see FIG. 3 element 21).

Figure 5:
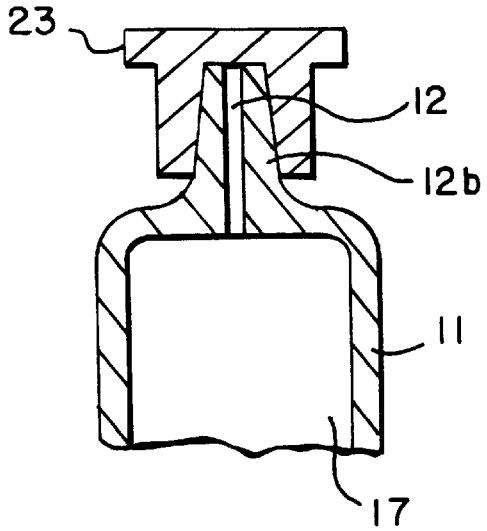
FIG. 5 is a cutaway longitudinal cross-sectional view through a burette cylinder with a rounded head and an elastomeric cap for closure.

The head of the burette cylinder 11 is formed with corners in the embodiments shown in FIGS. 1 and 4. Of course the head can have other forms, e.g. rounded contours with a conical connector tapering to a tip or point. This type of embodiment is illustrated in connection with an elastomeric cap 23 in FIG. 5.

The burette cylinder can also take the form of a standard spray device according to DIN 12 098.

Typical filling volumes of the burette cylinder are between 2 ml and 100 ml, the inner diameter of the burette cylinder depends on the required dosage accuracy, which typically is in the range of from about 4 mm to about 26 mm.

Instead of the connector 18 with its trapezoidal cross-section also other connectors, such as a toggle joint with a set break point.

The disclosure in German Patent Application 197 39 140.0–52 of Sep. 6, 1997 is incorporated here by reference. This German Patent Application describes the invention described hereinabove and claimed in the claims appended hereininbelow and provides the basis for a claim of priority for the instant invention under 35 U.S.C. 119.

While the invention has been illustrated and described as embodied in a piston burette for a burette apparatus, it is not intended to be limited to the details shown, since various modifications and changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and is set forth in the following appended claims:

We claim:

1. A pre-filled piston burette for both storage and delivery of a reagent, said pre-filled piston burette comprising a burette cylinder (11) for storing the reagent and for dispensing the reagent, wherein said burette cylinder (11) is provided with an outlet opening (12) at one end thereof and has a uniformly constant inner diameter, said burette cylinder consisting of a plastic material, said plastic material consisting of a transparent cycloolefin copolymer;

a predetermined amount of the reagent (17) pre-filled in the burette cylinder;

removable means for closing the burette cylinder (11) so that the reagent (17) is held in the burette cylinder for the purpose of storing the reagent, said removable means for closing the burette cylinder (11) comprising a removable closing cap (18,23) for closing the outlet opening (12) at the one end of the burette cylinder and a piston (13) slidably mounted in the burette cylinder (11) to close another end of the burette cylinder opposite or remote from the one end closable by the removable closing cap (18);

means for dispensing a measured portion of the reagent from the burette cylinder, said means for dispensing comprising said piston (13) slidably mounted in the burette cylinder and means for conducting the reagent (17) from the burette cylinder, said means for conducting the reagent (17) comprising a metering tube (19) and a connector (21) for connecting the metering tube (19) with the outlet opening (12) of the burette cylinder when the removable closing cap is not closing the burette cylinder; and means (15) for releasable attachment of the burette cylinder (11) in a burette apparatus (10), said burette apparatus including a motorized drive (16) and means for connecting the motorized drive (16) to the piston (13) to move the piston (13) in the burette cylinder so as to dispense the reagent, said means (15) for releasable attachment of the burette cylinder (11) being located at said another end of said burette cylinder.

2. The pre-filled piston burette as defined in claim 1, further comprising a lubricant for lubrication of a sliding motion of said piston in said burette cylinder.

3. The pre-filled piston burette as defined in claim 1, wherein the piston (13) is made of a material selected from the group consisting of fluoropolymers, rubber laminated with fluoropolymers and teflon.

4. A pre-filled piston burette for both storage and delivery of a reagent, said pre-filled piston burette comprising a burette cylinder (11) for storing the reagent and for dispensing the reagent, wherein said burette cylinder (11) is provided with an outlet opening (12) at one end thereof, said burette cylinder has a uniformly constant inner diameter and consists of a plastic material with an oxygen-impermeable barrier layer coated on an interior surface of the plastic material in contact with the reagent, said plastic material consisting of cycloolefin copolymer;

a predetermined amount of the reagent (17) pre-filled in the burette cylinder;

removable means for closing the burette cylinder (11) so that the reagent (17) is held in the burette cylinder for the purpose of storing the reagent, said removable means for closing the burette cylinder (11) comprising a removable closing cap (18,23) for closing the outlet opening (12) at the one end of the burette cylinder and a piston (13) slidably mounted in the burette cylinder (11) to close another end of the burette cylinder opposite or remote from the one end closable by the removable closing cap (18);

means for dispensing a measured portion of the reagent from the burette cylinder, said means for dispensing comprising said piston (13) slidably mounted in the burette cylinder and means for conducting the reagent (17) from the burette cylinder, said means for conducting the reagent (17) comprising a metering tube (19) and a connector (21) for connecting the metering tube (19) with the outlet opening (12) of the burette cylinder when the removable closing cap is not closing the burette cylinder; and means (15) for releasable attachment of the burette cylinder (11) in a burette apparatus (10), said burette apparatus including a motorized drive (16) and means for connecting the motorized drive (16) to the piston (13) to move the piston (13) in the burette cylinder so as to dispense the reagent, said means (15) for releasable attachment of the burette cylinder (11) being located at said another end of said burette cylinder.

5. The piston burette as defined in claim 4, further comprising a lubricant for motion of said piston in said burette cylinder.

6. The piston burette as defined in claim 4, wherein the piston (13) is made of a material selected from the group consisting of fluoropolymers, rubber laminated with fluoropolymers and teflon.

* * * * *